US008950908B2

(12) United States Patent
Berman

(10) Patent No.: US 8,950,908 B2
(45) Date of Patent: Feb. 10, 2015

(54) RECESSED LIGHTING STRIP THAT INTERLOCKS BETWEEN INSULATED ROOF PANELS

(76) Inventor: Daniel Joseph Berman, Lake Arrowhead, CA (US)

( * ) Notice: Subject to any disclaimer, the term of this patent is extended or adjusted under 35 U.S.C. 154(b) by 463 days.

(21) Appl. No.: 12/942,233

(22) Filed: Nov. 9, 2010

(65) Prior Publication Data

US 2011/0134651 A1 Jun. 9, 2011

Related U.S. Application Data

(63) Continuation-in-part of application No. 29/351,581, filed on Dec. 8, 2009, now Pat. No. Des. 632,417.

(60) Provisional application No. 61/311,475, filed on Mar. 8, 2010.

(51) Int. Cl.

| | |
|---|---|
| ***F21V 15/00*** | (2006.01) |
| ***F21V 17/00*** | (2006.01) |
| ***G09F 7/18*** | (2006.01) |
| ***F21V 15/01*** | (2006.01) |
| ***F21S 8/02*** | (2006.01) |

(52) U.S. Cl.
CPC *F21V 15/013* (2013.01); *F21S 8/02* (2013.01)
USPC ..... 362/364; 362/365; 362/362; 362/217.1; 362/217.11; 362/217.12; 362/217.13; 362/217.14; 362/217.15; 362/217.16; 362/217.17; 362/648; 362/147; 362/374; 362/148; 362/150; 312/223.5; 220/3.7; 220/477; 52/39; 52/220.1; 248/342; 248/343

(58) Field of Classification Search
USPC ..... 248/342, 343; 362/365, 364, 362, 362/217.1, 217.11–217.17, 648, 147, 374, 362/148, 150, 217.01; 312/223.5; 220/3.7, 220/477; 52/39, 220.1
See application file for complete search history.

(56) References Cited

U.S. PATENT DOCUMENTS

| | | | | | |
|---|---|---|---|---|---|
| 2,137,536 | A | * | 11/1938 | McConnell | 174/72 C |
| 2,503,876 | A | * | 4/1950 | Krauss | 362/217.1 |
| 2,516,660 | A | * | 7/1950 | Versen | 362/364 |
| D166,034 | S | | 2/1952 | Gray | |
| 3,123,310 | A | * | 3/1964 | Dameral | 362/221 |
| 3,663,808 | A | | 5/1972 | Baatz | |
| 3,786,171 | A | * | 1/1974 | Shira | 174/504 |
| 4,219,869 | A | * | 8/1980 | Bowman et al. | 362/147 |
| D270,377 | S | | 8/1983 | Maguire | |
| 5,083,248 | A | * | 1/1992 | Troy | 362/147 |
| 5,174,642 | A | * | 12/1992 | Brohard et al. | 362/20 |
| D359,374 | S | | 6/1995 | Weinstock | |
| D374,736 | S | | 10/1996 | DeWinter | |
| 5,581,448 | A | * | 12/1996 | Harwood | 362/147 |
| D397,486 | S | | 8/1998 | Engle et al. | |

(Continued)

*Primary Examiner* — Christopher Garft
(74) *Attorney, Agent, or Firm* — Kirk A. Buhler; Buhler & Associates

(57) ABSTRACT

An improvement in a recessed lighting strip that interlocks between insulated roof panels is presented herein. The recessed lighting strip uses mating interlocks to snap between the insulated panels, providing a method to place lights at each panel juncture across the width of the application, without violating the integrity of the panels themselves. The lighting strip is made from extruded plastic or aluminum that is essentially an open-topped rectangular box, shaped on the sides to interlock with foam insulated room panels that are typically 3"-6" thick and used in the construction of patio covers, patio enclosures, sunrooms and all other residential and commercial applications which use insulated roof panels.

10 Claims, 5 Drawing Sheets

(56) References Cited

U.S. PATENT DOCUMENTS

| | | | | |
|---|---|---|---|---|
| 5,921,655 | A * | 7/1999 | Nassim | 362/147 |
| 5,927,845 | A | 7/1999 | Gustafson et al. | |
| 6,174,076 | B1 * | 1/2001 | Petrakis et al. | 362/365 |
| 6,217,189 | B1 * | 4/2001 | Nassim | 362/147 |
| 6,354,714 | B1 * | 3/2002 | Rhodes | 362/153.1 |
| 6,357,891 | B1 * | 3/2002 | Newbold et al. | 362/147 |
| 6,616,309 | B2 * | 9/2003 | Kelmelis et al. | 362/371 |
| 6,659,623 | B2 | 12/2003 | Friend | |
| D563,012 | S | 2/2008 | Citterio | |
| D567,985 | S | 4/2008 | Komar et al. | |
| 7,413,323 | B2 * | 8/2008 | Lippis et al. | 362/147 |
| D580,087 | S | 11/2008 | Couture et al. | |
| D595,887 | S | 7/2009 | Blom | |
| 7,607,812 | B2 | 10/2009 | Kim | |
| D603,549 | S | 11/2009 | Ng | |
| 7,618,167 | B2 * | 11/2009 | Bedard | 362/366 |
| D605,787 | S | 12/2009 | Barton | |
| D606,229 | S | 12/2009 | Johansen et al. | |
| 7,744,253 | B2 * | 6/2010 | Engel | 362/297 |
| 7,841,135 | B2 * | 11/2010 | Newbold et al. | 52/28 |
| 2005/0201094 | A1 * | 9/2005 | Plunk | 362/260 |
| 2006/0245178 | A1 * | 11/2006 | Engel | 362/147 |
| 2008/0174993 | A1 | 7/2008 | Hsieh et al. | |
| 2009/0310371 | A1 * | 12/2009 | Goode | 362/365 |

* cited by examiner

RECESSED LIGHTING STRIP THAT INTERLOCKS BETWEEN INSULATED ROOF PANELS

CROSS REFERENCE TO RELATED APPLICATION

This application claims the benefit of design application Ser. No. 29/351,581 filed Dec. 8, 2009 and provisional application 61/311,475 filed Mar. 8, 2010 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in recessed lighting. More particularly, the present recessed lighting is a strip that interlocks between insulated roof panels in patio covers, patio enclosures, sunrooms and all other residential and commercial applications which use insulated roof panels.

2. Description of Related Art Including Information Disclosed Under 37 CFR 1.97 and 1.98

Lighting inside a patio cover is difficult because the insulated panels do not have any electrical wiring running through the insulated panels. There are products that are currently available that modify of the original foam insulated panel by drilling holes into the existing panel and lights are places into those drilled holes. Several products and patents have been issued that provide a retrofit solution to incorporate lighting into the patio covers. Exemplary examples of patents covering these products and methods are disclosed herein.

U.S. Pat. No. 7,618,167 issued to Sylvain Bedard on Nov. 17, 2009 discloses a recessed light fixture, with a securing system that clamps onto a flat surface. This patent does not disclose installation as an elongated panel that is interchangeable with existing patio covers.

U.S. Pat. No. 5,927,845 issued to Thomas L. Gustafson et al issued Jul. 27, 1999 and U.S. Pat. No. 6,659,623 issued to Ross Anthony Friend, issued on Dec. 9, 2003 both disclose a strip lighting system that is installed in the ground or in a receiving recess. These lighting strips are for placement on or within a ground or wall surface to provide illumination. While these patents disclose an elongated illumination strip they do not anticipate a lighting system that operates with a roof panel.

U.S. Pat. No. 7,607,812 issued to Steven Kim on Oct. 27, 2009 discloses a light emitting diode panel fixture. The LED strip attaches to a light guide panel. While these patents disclose an elongated illumination strip it does not anticipate a lighting system that operates with a roof panel.

What is needed is a lighting strip made from extruded aluminum that is essentially an open-topped rectangular box, shaped on the sides to interlock with foam insulated room panels that are typically 3"-6" thick and used in the construction of patio covers, patio enclosures, sunrooms and all other residential and commercial applications which use insulated roof panels.

BRIEF SUMMARY OF THE INVENTION

It is an object of the recessed lighting strip for insulated roof panels for the light strip to be self-contained whereby the light strip is fabricated with the light(s) and wiring that allows the light strip to be interlocked with the ceiling or wall panels. The wiring can then be connected to a junction or switch box by an electrician. The panels can be installed in both a horizontal configuration for a ceiling or in a vertical configuration for installation on a wall. In addition to providing lighting the panels can also be configured for the installation of speakers, sound connection ports or electrical switch outlets or control boxes such as switches.

It is an object of the recessed lighting strip for insulated roof panels for the light strip to be configured in a plurality of compatible ceiling or wall panels. Each manufacturer of ceiling or wall panels may have a unique interlocking system that ensures that future expansion can only be made from the same manufacturer. This requires the extrusion(s) to be configured in heights of four, six, eight inches or more based upon the insulation and structural properties that are desired. A panel can vary from 2'-30' in length, depending on individual application. The width of the ceiling or wall panels is also variable to ensure that the panel has a similar appearance. The panels can also be fabricated, coated or otherwise treated to match the color and or texture of other ceiling or wall panels.

It is an object of the recessed lighting strip for insulated roof panels for the light strip for the panel to be fabricated from an extrusion process that produces the panel from plastic, aluminum or other metals or recycled materials. Most ceiling or wall panels are fabricated from aluminum or plastics to provide some structural strength. The extrusions are fabricated or can be filled with insulating material to improve the thermal, acoustical and structural properties.

It is an object of the recessed lighting strip for insulated roof panels for the light strip to be fabricated to accommodate a wire chase or conduit to aid in wiring, wire protection and or electrical installation. This feature can be extruded with the panel or can be added with bonding or fastening.

It is still another object of the recessed lighting strip for insulated roof panels for the lighting strip to be fabricated from any ferrous or non-ferrous metals besides aluminum, or any material such as plastic, carbon fiber or fiberglass capable of being formed into the required shape while maintaining a requisite strength and weather resistance.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
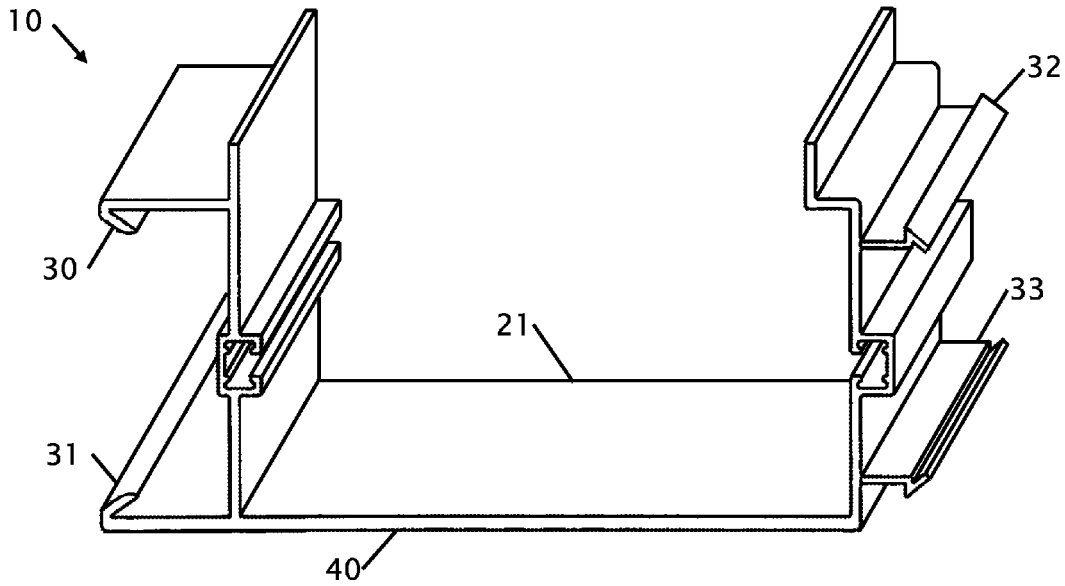
FIG. 1 shows an isometric view of a first preferred embodiment of the recessed lighting strip.
Figure 2:
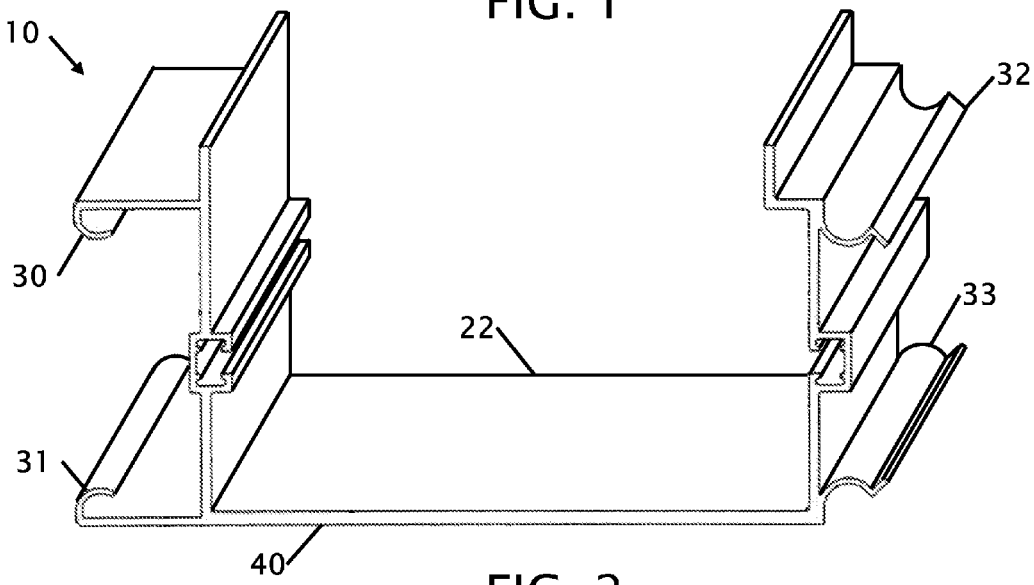
FIG. 2 shows an isometric view of a second preferred embodiment of the recessed lighting strip.
Figure 3:
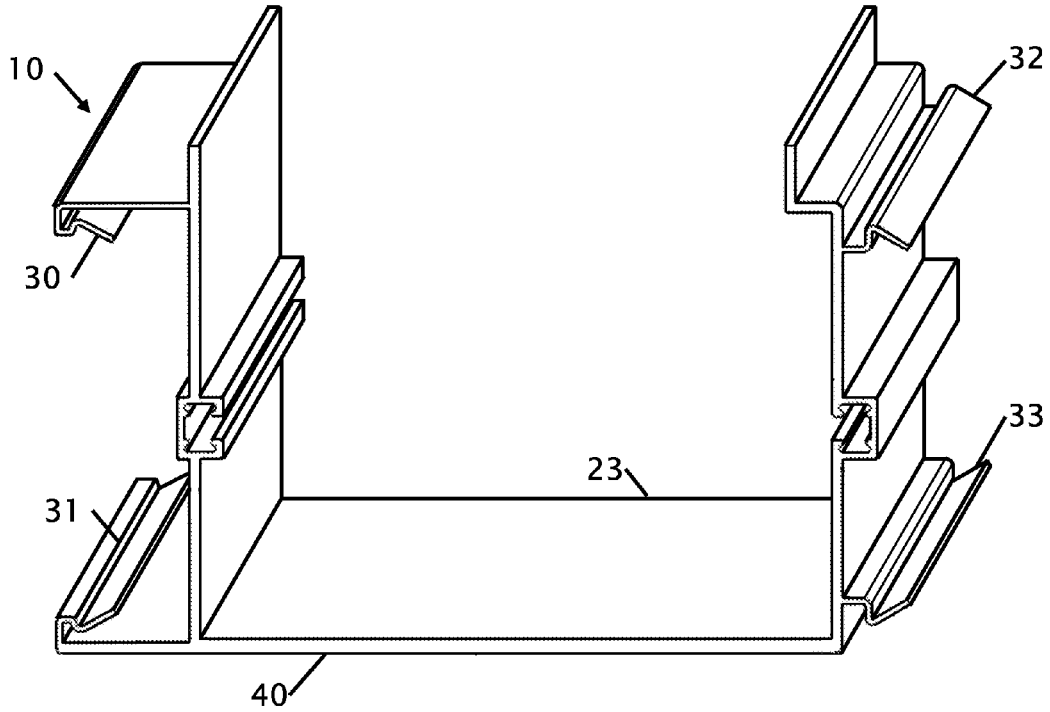
FIG. 3 shows an isometric view of a third preferred embodiment of the recessed lighting strip.
Figure 4:
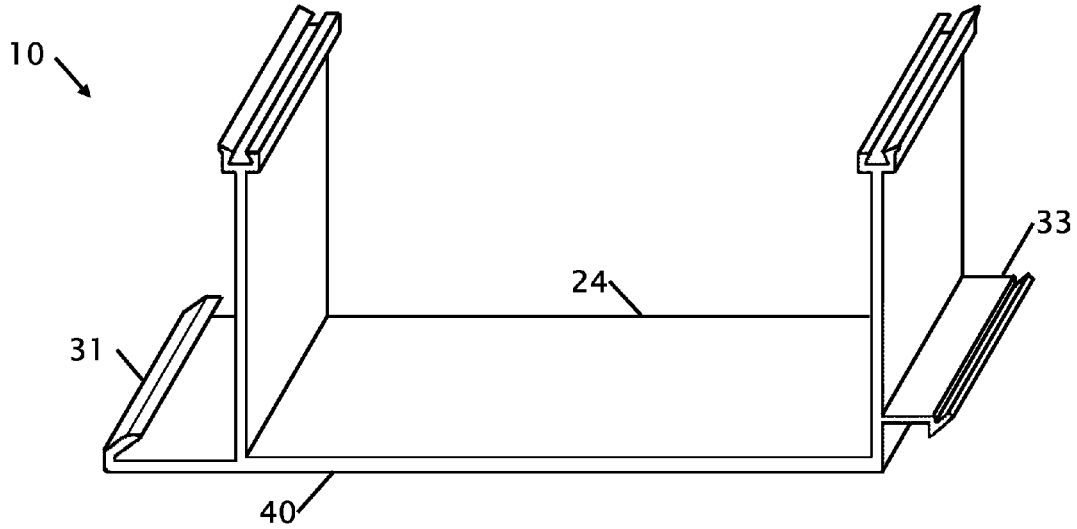
FIG. 4 shows an isometric view of a forth preferred embodiment of the recessed lighting strip.
Figure 5:
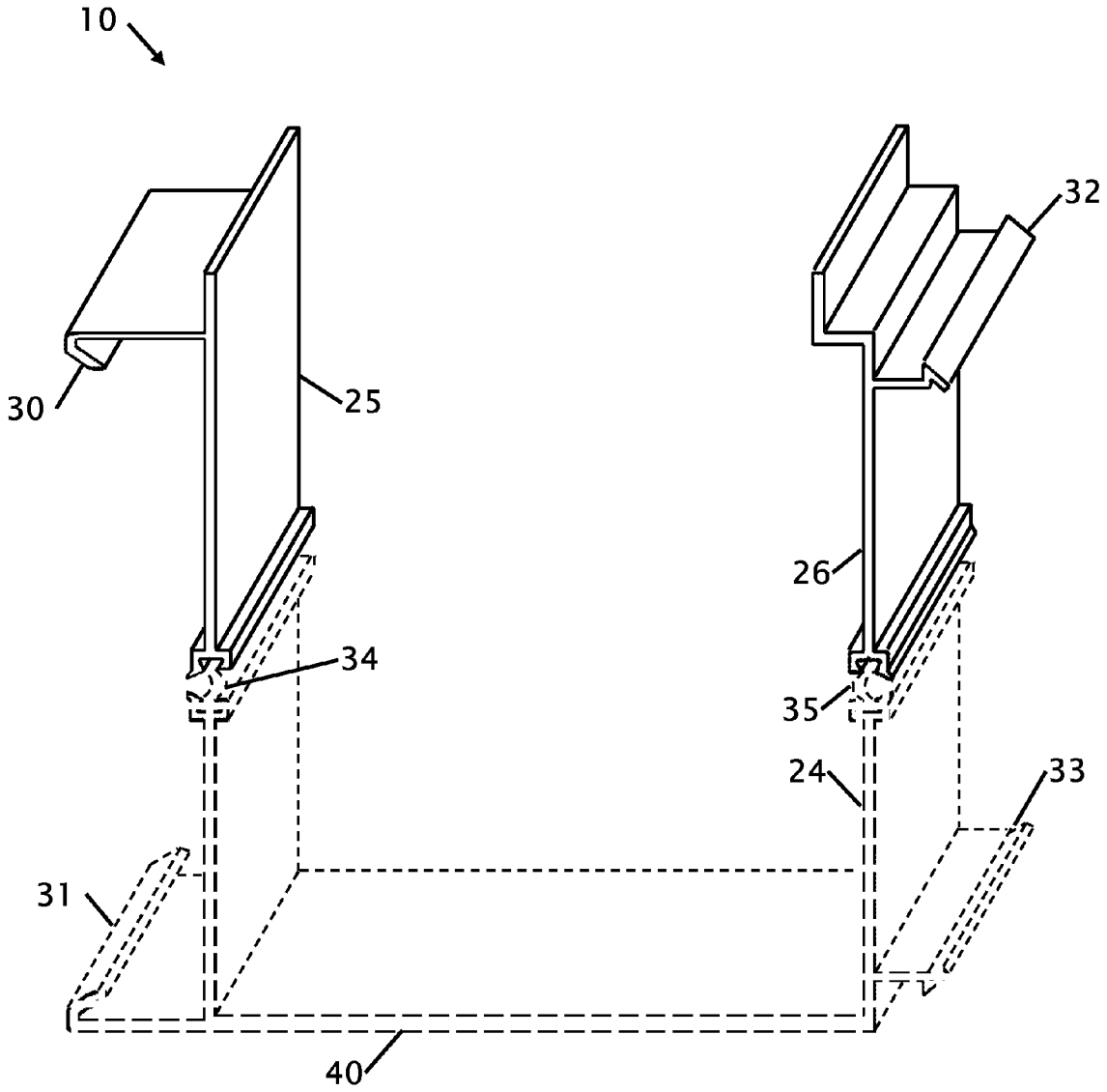
FIG. 5 shows an isometric view of a fifth preferred embodiment of the recessed lighting strip using the strip from FIG. 4.

FIGS. 1 to 5 show various configurations of an extruded profile that creates various embodiments of the initial shows that forms the lighting strip. Each profile is uniquely configured to mate with the insulated roof panel from different manufacturers. In FIG. 5 the lighting strip is configured from an assembly of three pieces where the bottom piece 24 is the extrusion that is shown in FIG. 4.

A lighting strip 10 is preferably made from extruded aluminum of a thickness between 0.0625" and 0.1875", between 6", 8" and 12" wide and between 3", 6" and 8" high, depending on version. The light strip is essentially an open-topped rectangular box, shaped on the sides to interlock 30-33 with foam insulated room panels (3"-8" thick) used in the construction of patio covers, patio enclosures, sunrooms and all other residential and commercial applications which use insulated roof panels. While these specific dimensions are stated they are variable based upon the insulated wall or roof panel they are mated with.

Figure 6:
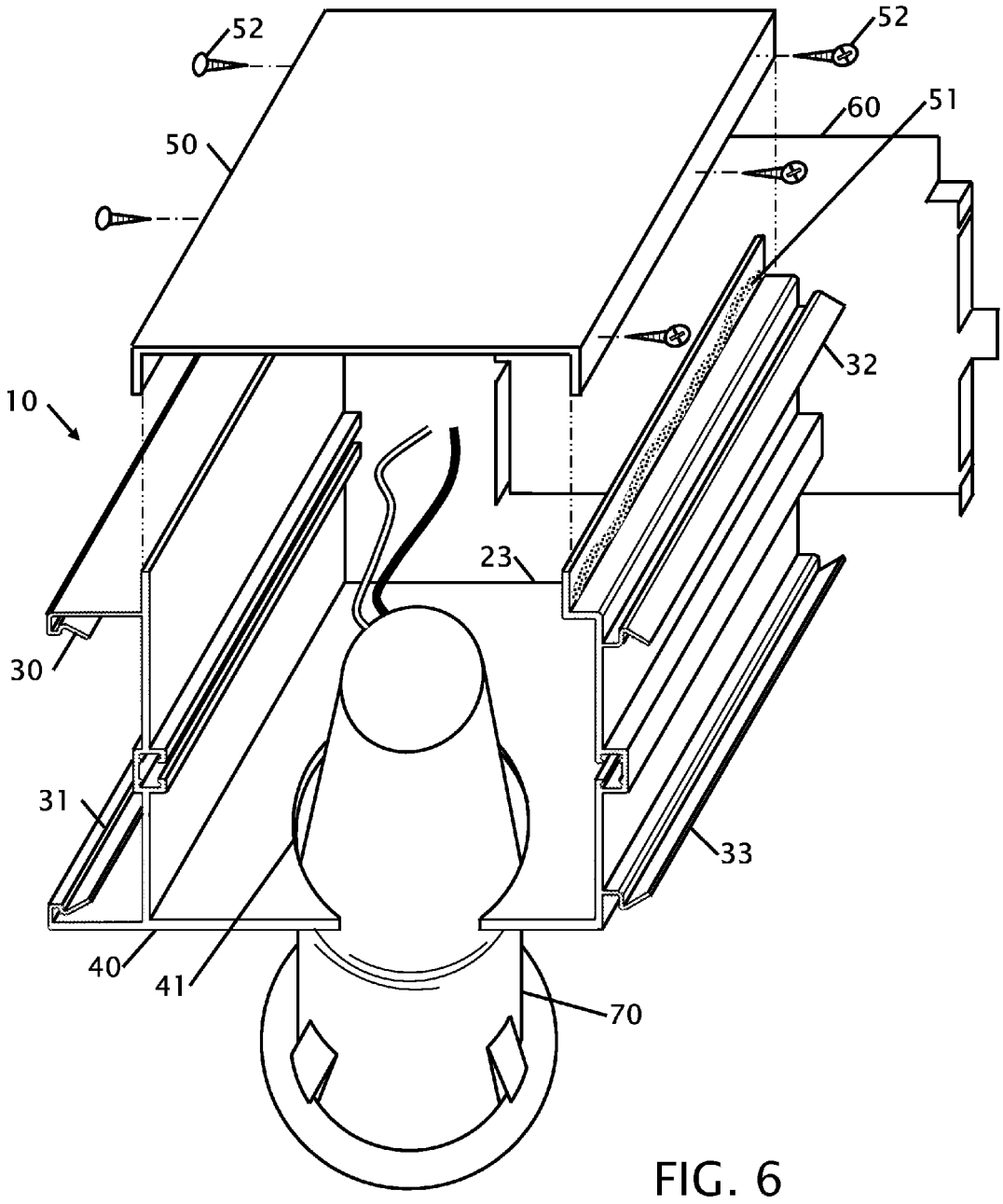
FIG. 6 shows an isometric view of a first preferred embodiment of the recessed lighting strip.

In a single piece body construction with a solid bottom (as shown in FIGS. 1-4), the solid bottom 40 is cut and fitted with one to eight or more listed recessed light fixture having 4"-8" diameter circular recessed lights 70, wired in series, then capped with a separate weather resistant top 50 as shown in FIG. 6.

Figure 7:
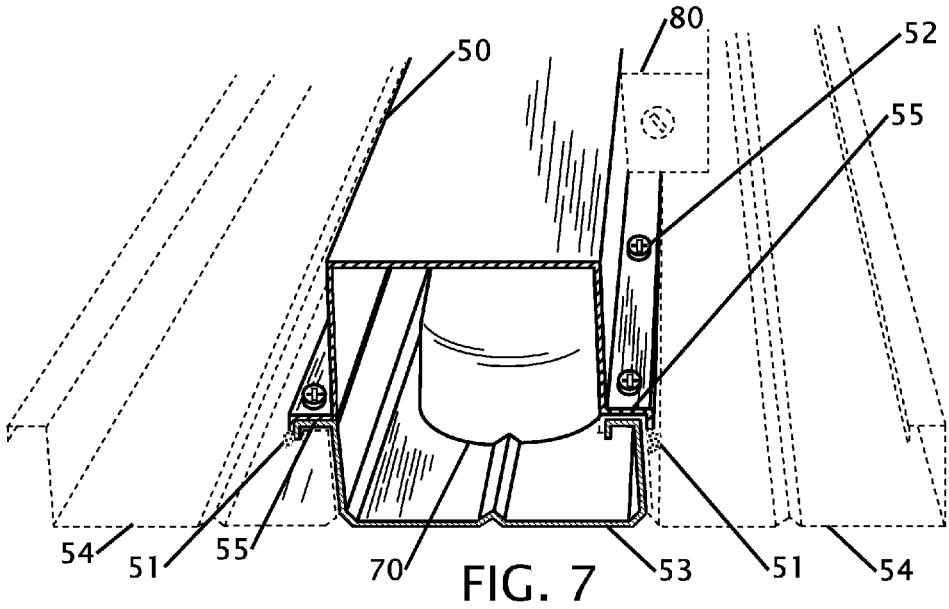
FIG. 7 shows an isometric view of the recessed lighting strip fabricated out of sheet metal.

End cap(s) 60 (front and rear) may be attached for additional weather resistance. Either end cap 60, as well as the top cap 50, can be fitted with an electrical junction box 80 (as shown in FIG. 7 to allow wiring to the home and to additional lighting strips. Products will vary from 2'-30' in length, depending on individual application.

All elements listed prior to this are essential to the finished product. Dimmer switches could be added to the lighting circuit to vary the amount of light at any one time. Special orders could be placed for color matching the extruded framework to existing panels.

One to eight or more listed recessed light fixture 70 is fitted into holes 41 cut in a framework 40 of extruded aluminum and then wired in series. This wired construct is then capped with a weather resistant top 50. The sides of the finished construct are shaped during the extrusion process to provide an interlocking 30-33 connection between foam insulated panels marketed for roof construction in patio covers, patio enclosures, sunrooms and a wide range of residential and commercial applications. The front and rear of the box are fitted with protective weather resistant caps 60, and either can be fitted with the electrical connection point or junction box 80 to join the strip to the home lighting circuit and/or another light strip.

The shape of the body is two-fold. The interior box construction allows for the cutouts for insertion of the recessed lighting fixtures and all associated wiring. Wiring for any additional accessory items such as speakers, security cameras, etc. would also be run inside this interior space. The exterior shape of the sides provides for the connection between the construct itself and the insulated foam panels previously mentioned for construction purposes. The aluminum extrusion would be capped 50 with a separate aluminum top cap 50 which is insulated on the interior. This top cap 50 is to be caulked 51 and attached with screws 52 to provide weather resistance. Lighting strips made from materials other than aluminum will have appropriate caps constructed of a like or similar strength material to ensure the required strength/span limitations are met or exceeded. End caps 60 will provide additional weather resistance, and also allow for the attachment of an electrical junction box 80 to allow for connection to the home/business' electrical power and/or additional lighting strips.

Aluminum is extruded into the desired shape to allow interlocking with foam insulated panels, and of a size to contain the required number of recessed light fixtures.

The lighting strip 10 can be made from any ferrous or non-ferrous metals besides aluminum or any material such as plastic, carbon fiber or fiberglass capable of being formed into the required shape while maintaining a requisite strength and weather resistance. Holes 41 are cut to an appropriate size for the insertion of desired circumference lighting fixtures 70 and these are wired in series and sealed in their respective holes, with an appropriate amount of wiring extended for attaching to a power circuit and/or another lighting strip. A separate top cap 50 is shaped for attachment and attached with caulking 51 and screws 52 to provide additional weather resistance. End cap(s) 60 are caulked 51 and attached with screws 52 to provide additional weather resistance and to provide an attachment point for an electrical junction box 80 to allow connection to a power circuit or to additional lighting strips.

Different sized or colored lights, dimmers, effects (strobes, etc.) could be used. The shape of the box could be altered to allow the lighting to be cast at an angle, such as instead of a flat bottom it could be "V" shaped. Also, directional lighting adapters could be placed in the fixed sockets to project the lighting in alternate directions. Light fixtures could be placed closer or farther apart. The lighting strip could be made taller and/or wider, allowing for upward directional lighting as well as downward, also horizontal "security" or "mood" or "area" lighting could shine outward from the strip. Entertainment or security options such as music or communications speakers as well as security or internet cameras could be installed inside the lighting strip with the lights. The interior of the lighting strip 10 provides additional space for additional wiring. It is also contemplated that heat lamps could either replace or be used in conjunction with regular lighting to provide heat or other health benefits. The lighting strips 10 can also be placed vertically as a wall structure in order to space light evenly throughout a space, for example, a paint booth or photographic studio.

FIG. 5 shows an isometric view of a fifth preferred embodiment of the recessed lighting strip using the strip from FIG. 4. In FIG. 4 the recessed lighting strip is an extruded shape 40 having an essentially flat bottom surface, a left surface and a right surface that are essentially perpendicular with said essentially flat bottom 40. The left surface is configured to connect through a compliant coupling 34 to an upper left surface 25. The right surface is configured to connect through a second compliant coupling 35 to an upper right surface 26. The left surface, the upper left surface 25, the right surface and the upper right surface 26 are configured with complementary interlocking features 30-33 that are configured to interlock with roof or wall panels. The extruded bottom shape further can have at least one hole to accept an electrical device such as, but not limited to a light, heat lamp or speaker.

This invention would be used to provide recessed lighting for a patio cover, patio enclosure, sunroom and all other residential and commercial applications which use insulated roof panels, by having this invention installed concurrently with, and as part of, the construction/decoration project. Retrofitting an existing structure/application would also be possible with some disassembly of the original, and reassembling while placing the lighting strips between the insulated foam panels.

The embodiment shown in FIG. 7 is fabricated from bent sheet metal top 50 and bottom 53 pieces that are shown mated with standard roof panel members 54. The lighting fixture 70 is shown inserted through the bottom sheet metal panel with an electrical junction box 80 mounted on the outside of the sheet metal top cover 50. The outer ears 55 of the sheet metal top cover bend over the mated bottom pieces 54. The sheet metal top 50 cover is sealed with caulking 51 and further secured with screws 52.

Figure 8:
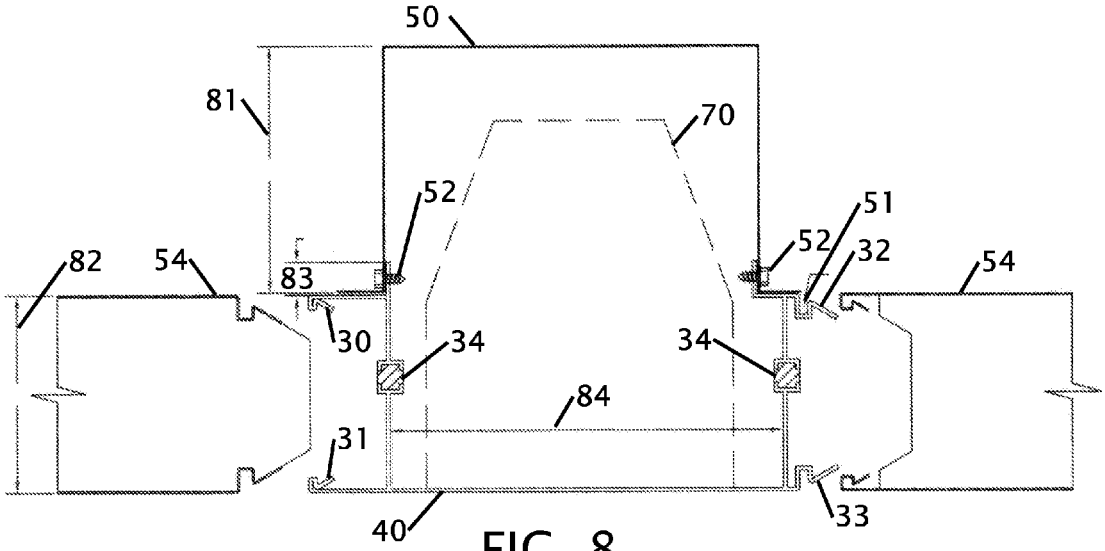
FIG. 8 shows a sectional view of a panel with mating foam cores.

FIG. 8 shows a sectional view of a panel with mating foam cores. This cross section shows the metal top 50 mated onto the extruded frame. The light strip is essentially an open-topped rectangular box, shaped on the sides to interlock 30-33 with foam insulated room panels (3"-8" thick) 82. The height 81 of the metal top 50 is generally dictated by the height of the lighting fixture 70 plus some additional clearance for convection cooling when the lighting fixture 70 is secured into the bottom 40 of the extruded shape. The metal top 50 is secured or screwed 52 to the extruded housing through a lip 83 that is created between metal top 50 and the extrusion.

Thermal breaks in the form of a compliant coupling 34 bridges or joins the open-topped rectangular box. The connection between adjoining sections are sealed 51 or caulked to eliminate an air gap between interlocks 30-33 and lock adjoining male and female parts 54 together. The width dimension of the light panel is preferably 6 inches across 84 but other wider and narrower dimensions are contemplated.

Thus, specific embodiments of a recessed lighting strip that interlocks between insulated roof panels have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A recessed lighting or speaker strip that connects between ceiling panels or wall panels comprising:

an elongated extruded-shape having an essentially flat bottom surface, a left surface and a right surface that are essentially perpendicular with said essentially flat bottom;

said left and said right surfaces having complementary connecting features that connect between at least two separate ceiling panels or at least two separate wall panels;

said bottom surface is parallel with a bottom surface of said at least two separate ceiling panels or said at least two separate wall panels;

said extruded shape further having at least one hole in said bottom surface to accept an electrical device, wherein said electrical device is a light or a speaker that is recessed within said elongated extruded shape;

a top cover that extends substantially beyond said left and said right surfaces complementary connecting features and over said electrical device;

wherein said top cover is sealed and fastened to said at least two separate ceiling panels or said at least two separate wall panels, and an electrical junction box that is secured to an exterior surface of said top cover and connects to said electrical device.

2. The recessed lighting or speaker strip according to claim 1 wherein said extruded shape is extruded aluminum, plastic, carbon fiber, fiberglass or metal.

3. The recessed lighting or speaker strip according to claim 1 wherein said left and said right side surfaces are 3 inches, 6 inches or 8 inches in height.

4. The recessed lighting or speaker strip according to claim 1 wherein said essentially flat bottom surface creates a 6 inch, 8 inch or 12 inch spacing between said ceiling or wall panels.

5. A recessed lighting or speaker strip that connects with sheet metal ceiling panels comprising:

an elongated sheet metal form having an essentially flat bottom surface forming a bottom surface of a ceiling;

said sheet metal form further having a left surface and a right surface that are essentially perpendicular with said essentially flat bottom;

said left and said right surfaces having complementary connecting features that connect between at least two separate said ceiling panels;

a top cover that extends substantially beyond said left and said right complimentary connecting features that mate with said left surface and said right surface;

said elongated extruded shape having said bottom surface parallel with a bottom surface of said at least two separate ceiling panels;

said sheet metal form further having at least one hole in said bottom surface that accepts an electrical device, wherein said electrical device is a light or a speaker that is recessed within said elongated sheet metal form and said top cover;

wherein said top cover is sealed and fastened to said at least two separate ceiling panels, and further including an electrical junction box that is secured to an exterior surface of said top cover.

6. The recessed lighting or speaker strip according to claim 5 wherein said sheet metal form is aluminum or steel.

7. The recessed lighting or speaker strip according to claim 5 wherein said left and said right surfaces having an overall 3 inches, 6 inches or 8 inches in height.

8. The recessed lighting or speaker strip according to claim 5 wherein said essentially flat bottom surface creates a 6 inch, 8 inch, or 12 inch spacing between ceiling panels.

9. The recessed lighting or speaker strip according to claim 1 wherein said recessed lighting or speaker strip extends from a first ceiling or wall panel to a second opposing ceiling or wall panel.

10. The recessed lighting or speaker strip according to claim 5 wherein said recessed lighting or speaker strip extends from a first ceiling panel to a second opposing ceiling panel.

* * * * *